US010621877B2

(12) United States Patent
Laakso

(10) Patent No.: US 10,621,877 B2
(45) Date of Patent: Apr. 14, 2020

(54) ILLUMINATOR

(71) Applicant: Obelux Oy, Helsinki (FI)

(72) Inventor: Vesa Laakso, Helsinki (FI)

(73) Assignee: Obelux Oy, Helsinki (FI)

( * ) Notice: Subject to any disclaimer, the term of this patent is extended or adjusted under 35 U.S.C. 154(b) by 0 days.

(21) Appl. No.: 15/382,764

(22) Filed: Dec. 19, 2016

(65) Prior Publication Data

US 2017/0178521 A1 Jun. 22, 2017

(30) Foreign Application Priority Data

Dec. 18, 2015 (EP) ..... 15201204

(51) Int. Cl.
*F21V 7/04* (2006.01)
*G08G 5/04* (2006.01)
(Continued)

(52) U.S. Cl.
CPC ..... *G08G 5/04* (2013.01); *F21V 7/00* (2013.01); *F21V 7/04* (2013.01); *F21V 13/04* (2013.01); *F21V 33/0076* (2013.01); *F21V 5/045* (2013.01); *F21W 2111/06* (2013.01); *F21Y 2101/00* (2013.01); *F21Y 2115/10* (2016.08)

(58) Field of Classification Search
CPC ..... F21V 13/04; F21V 33/0076; F21V 7/04; F21V 7/00; F21V 5/045; F21Y 2115/10; F21Y 2101/00; G08G 5/04; F21W 2111/06
See application file for complete search history.

(56) References Cited

U.S. PATENT DOCUMENTS 6,250,774 B1 * 6/2001 Begemann ..... F21S 8/086 362/231
6,461,029 B2 10/2002 Gronemeier et al.
(Continued)

FOREIGN PATENT DOCUMENTS

DE 102007009896 A1 9/2008
EP 1176053 A2 1/2002
(Continued)

OTHER PUBLICATIONS

Aerodromes, vol. 1 (Aerodrome Design and Operations) of Annex 14, International Civil Aviation Organization (ICAO), Jul. 2013.

*Primary Examiner* — Nay Tun
(74) *Attorney, Agent, or Firm* — Laine IP Oy

(57) ABSTRACT

According to an example aspect of the present invention, there is provided a novel illuminator 100 having a light source (10) and optics (20). The light source (10) and optics have light emitting and light path modifying components (11, 12, 21, 22, 23), which form two different combinations. The components of the first combination cooperate so as to output a first output light pattern (A) having a width in a plane and the components of the second combination cooperate such to output a second output light pattern (B) having a width in said plane. The width of the second output light pattern (B) is narrower than that of the first output light pattern (A), whereby the total output light pattern (A+B) of the illuminator (100) is a sum of the output light patterns (A, B) produced by the combinations of components (11, 12, 21, 22). The illuminator may be a flight obstacle illuminator or a navigational aid.

17 Claims, 5 Drawing Sheets

(51) Int. Cl.

| | |
|---|---|
| ***F21V 7/00*** | (2006.01) |
| ***F21V 13/04*** | (2006.01) |
| ***F21V 33/00*** | (2006.01) |
| *F21W 111/06* | (2006.01) |
| *F21V 5/04* | (2006.01) |
| *F21Y 101/00* | (2016.01) |
| *F21Y 115/10* | (2016.01) |

(56) References Cited

U.S. PATENT DOCUMENTS

| | | | | |
|---|---|---|---|---|
| 7,722,224 | B1 * | 5/2010 | Coleman | F21S 8/00<br>362/326 |
| 8,491,164 | B2 * | 7/2013 | Ford | F21V 5/04<br>362/311.01 |
| 2007/0002572 | A1 | 1/2007 | Ewig et al. | |
| 2010/0284193 | A1 * | 11/2010 | Ford | F21V 5/04<br>362/311.06 |
| 2016/0076722 | A1 * | 3/2016 | Hessling Von Heimendahl | B64D 47/04<br>362/470 |

FOREIGN PATENT DOCUMENTS

| | | | |
|---|---|---|---|
| EP | 2572990 | A1 | 3/2013 |
| EP | 2574837 | A2 | 4/2013 |
| EP | 2604521 | A1 | 6/2013 |
| EP | 2541134 | A3 | 9/2013 |
| EP | 2667087 | A1 | 11/2013 |
| EP | 3095641 | A1 | 11/2016 |
| WO | WO2006091225 | A1 | 8/2006 |

* cited by examiner

ILLUMINATOR

FIELD

The present invention relates to illuminated markers, specifically fixed illuminators for indicating the presence of a flight obstacle or for aiding navigation. In particular, the present invention relates to forming a particular lighting pattern of such an illuminator. More specifically, the present invention relates to an illuminator according to the preamble portion of claim 1.

BACKGROUND

Illuminated markers of various sorts are fixed to the environment to inform approaching vessels of obstacles that might pose a risk of a collision with the vessel or for indicating the appropriate route. In sea navigation, such markers are called navigational aids, which may take the form of lighthouses, buoys, fog signals, day beacons etc. In aviation, tall buildings, bridges and the like are provided with flight obstacle illuminators for warning an approaching aircraft of the presence of an obstacle. EP 2541134 A2, for example, discloses a flight obstacle illuminator with a plurality of light emitting components arranged inside a respective plurality of lenses.

There is regulation concerning the specification of illuminated markers. The output of flight obstacle illuminators, for example, is regulated by standards drawn up by local and international aviation bodies such as the International Civil Aviation Organization (ICAO). Volume 1 (Aerodrome Design and Operations) of Annex 14 to the Convention on International Civil Aviation by the ICAO, for example, contains strict minimum requirements for the output light pattern of flight obstacle illuminators. The regulations vary around the World. Common to all such regulations is that the desired light pattern should be directed to all horizontal directions around the illuminator at quite a narrow beam spread in the respective vertical planes. In other words, the light pattern should peak at a zero line, which is the horizontal radial direction from a leveled flight obstacle illuminator.

There are, however, also recommendations for maximum output light pattern. Many of the modern standards pose desired maximum values for the intensity of light directed to different vertical deviations from the zero line. When examining the light intensity of the light pattern in the vertical plane, the desired light pattern should have a relatively narrow peak section surrounded by decreased intensity sections at both sides of the peak, which decreased intensity sections are further surrounded by trailing low intensity sections further apart from the zero line. The decreased intensity sections between the peak and trailing low intensity sections create so called shoulders to the light pattern. Indeed, the required minimum and recommended maximum values define quite a narrow tolerance for the desired shape of the output light pattern.

It is therefore an object to provide an illuminator suitable for use as a flight obstacle illuminator or navigational aid having a controlled output light pattern that will not only achieve an adequate minimum output light pattern but also not exceed recommended maximum values for a given vertical deviation from the zero line.

SUMMARY

The aim is achieved with a novel illuminator having a light source and optics. The light source and optics have light emitting and light path modifying components, which form two different combinations. The components of the first combination cooperate so as to output a first output light pattern having a width in a plane and the components of the second combination cooperate such to output a second output light pattern having a width in said plane. The width of the second output light pattern is narrower than that of the first output light pattern, whereby the total output light pattern of the illuminator is a sum of the output light patterns produced by the combinations of components. The first combination of components includes a first light emitting component of the light source and a light path modifying component of the optics. The second combination of components includes a second light emitting component of the light source and a light path modifying component of the optics. The first light emitting component has a first optical size and the second light emitting component has a second optical size, which is smaller than the first optical size.

The invention is defined by the features of claim 1. Some specific embodiments are defined in the dependent claims.

Considerable benefits are gained with aid of the novel illuminator. Not only can the minimum output light intensity requirements be met but it is also possible to comply with the maximum output intensity recommendations at different elevations from the so called zero line. While catering for safe aviation and/or shipping, the ability to limit the intensity of the light pattern outside the required angle range significantly reduces the amount of "light pollution" emitted to the environment, namely to settled areas around tall buildings, bridges, wind farms, etc.

BRIEF DESCRIPTION OF EXEMPLARY EMBODIMENTS

Figure 1:
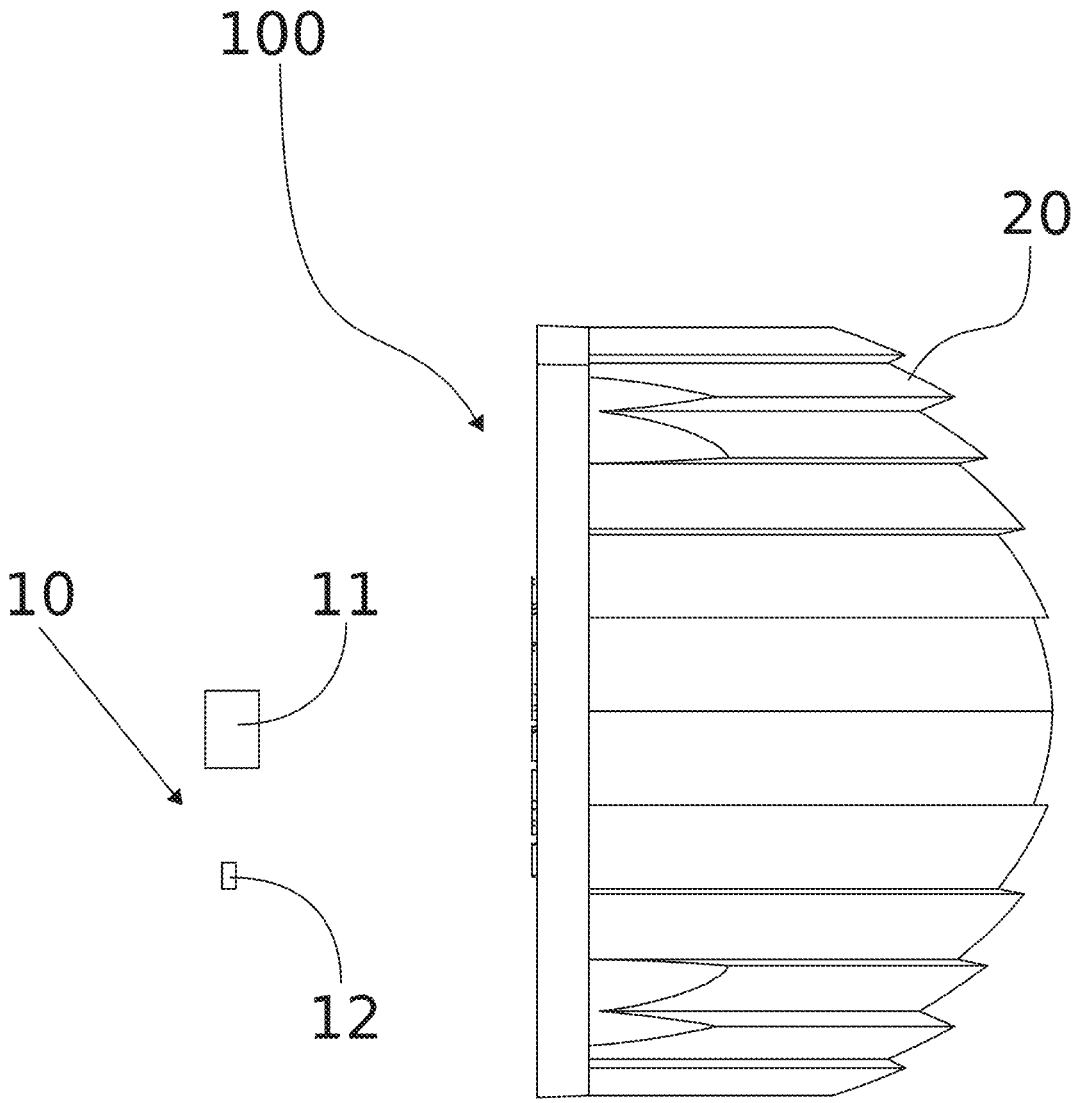
FIG. 1 illustrates a block side elevation view of an illuminator in accordance with an embodiment.

In a broad sense, the proposed exemplary solution provides an output light pattern particularly suitable for an illuminator for warning of a flight obstacle or for aiding navigation. The total output light pattern A+B is the sum of two light patterns A, B produced with two different combinations of components 11, 20; 12, 20. The proposed exemplary illuminator 100 includes a light source 10 with at least one light emitting component 11, 12 and optics 20 with at least one light path modifying component 21, 22, 23, which is positioned on the light path of the at least one light emitting component 11, 12. There are in any case enough components 11, 12, 21, 22, 23 in the light source 10 and optics 20 to form two different combinations of components that produce two different output light patterns A, B that have different widths in a plane.

One example of a suitable illuminator 100 is shown in FIG. 1, where the illuminator 100 includes a single lens 20 as optics and two light emitting components 11, 12 as the light source 10. The embodiments described with reference to the drawings relate specifically to a flight obstacle illuminator. The same principles apply, however, also to navigational aids. The two kinds of illuminated markers should therefore be considered as interchangeable throughout of this description. Also it should be understood that the components of the device can or are to be constructed as a single unit as opposed to being provided to separate illuminators.

In the illustrated embodiment, the first light emitting component 11 has a larger optical size than the second light emitting component 12. In this context, the term optical size refers to the size of the projection of an object as measured at the input surface of the light path modifying component of the optics. Another way of considering the optical size would be the size of an object as it appears to the light path modifying component. The optical size may be altered by varying the area of the light emitting surface of the light emitting component or by adding a dome to the light emitting component or both. The introduction of a dome to a light emitting surface will spread the emitted light beams so as to appear on a larger area on the input surface of the light path modifying component as compared to that of a domeless light emitting component. The first light emitting component 11 may therefore be a larger LED chip and the second light emitting component 12 a smaller LED chip as shown in FIG. 1 in an exaggerated fashion. The second light emitting component 12 may be for example 20 percent smaller than the first light emitting component 11 so as to create two light output patterns that are different enough. Alternatively or additionally, the first light emitting component is provided with a dome whereas the second light emitting component is domeless (not shown). With modern LED technology, the LED chips with and without domes may be integrated into a single or onto the same surface mounted device (SMD in short) placed under the light path modifying component. Here it should be noted that the possible dome on an LED chip is not considered as the lens or other light path modifying component. Instead, the components forming the cooperating combinations of components are distanced from each other by a space, whereby the light beams emitted by the light emitting component pass through the medium occupying said space. Accordingly, the potential dome on the light emitting component should be considered as an integrated piece of the light emitting component. In case two LED chips of different size are placed under a spot light lens, the widths of the output light patterns vary according to the size of the chips, which affects not only the vertical but also the horizontal beam spread.

Figure 2:
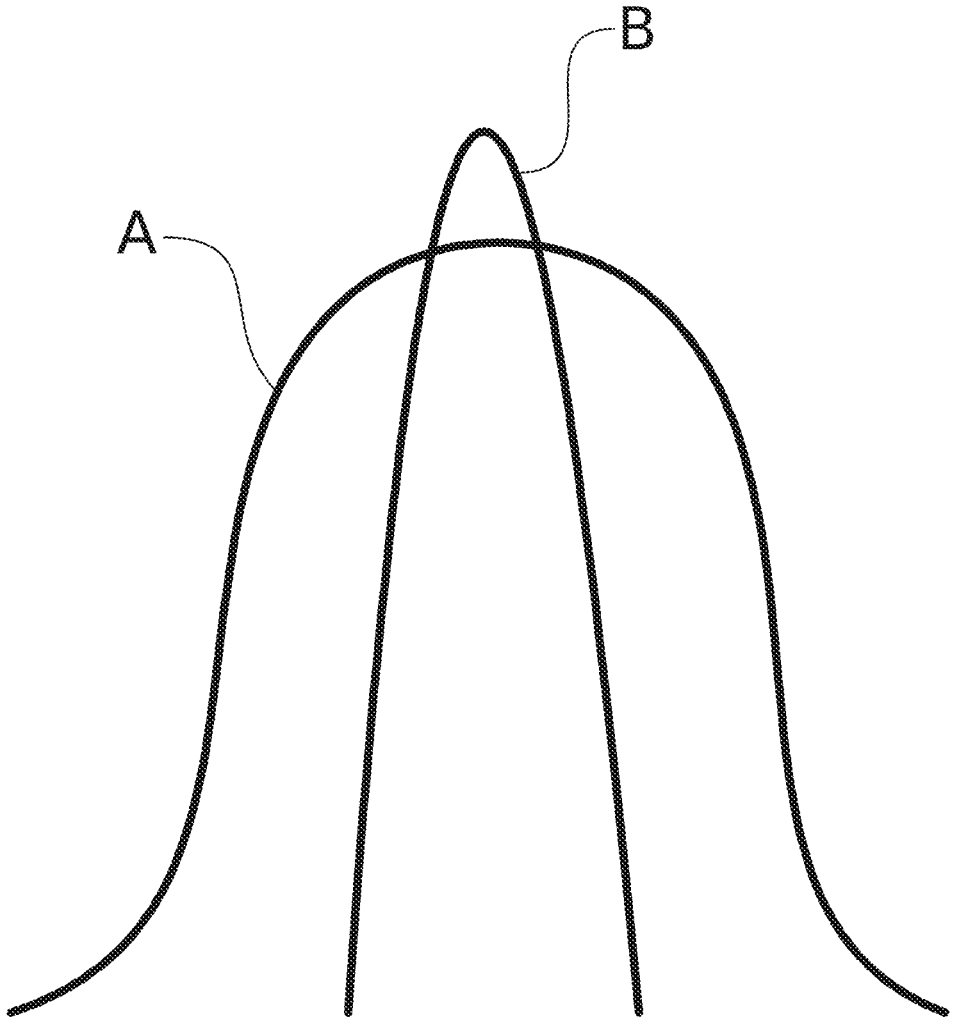
FIG. 2 illustrates a sketch of the light patterns produced by the components of the illuminator of FIG. 1.

The first light emitting component 11 emits light to the lens 20 such that they form a first cooperating combination of components, which produces an output light pattern A shown in FIG. 2. The lens 20 may be, for example, a Fresnel lens. The curves shown in FIG. 2 illustrate the spread of the intensity of light in both output light patterns A, B across the vertical plane that extends radially from the vertical center line of the flight obstacle illuminator. In other words, the diagram shows the light intensity as the function of deviation from the radial direction extending from the flight obstacle illuminator. In yet other words, FIG. 2 shows the so called vertical beam (spread) of the illuminator. As can be seen from FIG. 2, the first output light pattern A of the first combination of components 11, 20 is quite wide. By contrast, the second output pattern B produced by the second combination of components, namely the optically smaller light emitting component 12 and lens 20, is considerably narrower than the first output light pattern A. This is because the light originates from a more point-form source of light. On the other hand, the second output light pattern B has higher peak intensity than the first output light pattern A. The width of the output light pattern A, B is measured at half intensity, i.e. the so called full width at half maximum, FWHM. The components of the flight obstacle illuminator are arranged such that the output light patterns A, B are matched to some extent. In the illustrated example, the output light patterns A, B are mutually centered. It is, however, possible to offset the center lines of the output light patterns so as to create a total output light pattern, which is asymmetric in respect to the horizontal (not shown). Depending from the application of the illuminator, it may be preferable to offset the peak values of the output light pattern by even several degrees so as to adapt the total output light pattern to suit a particular demand.

Figure 3:
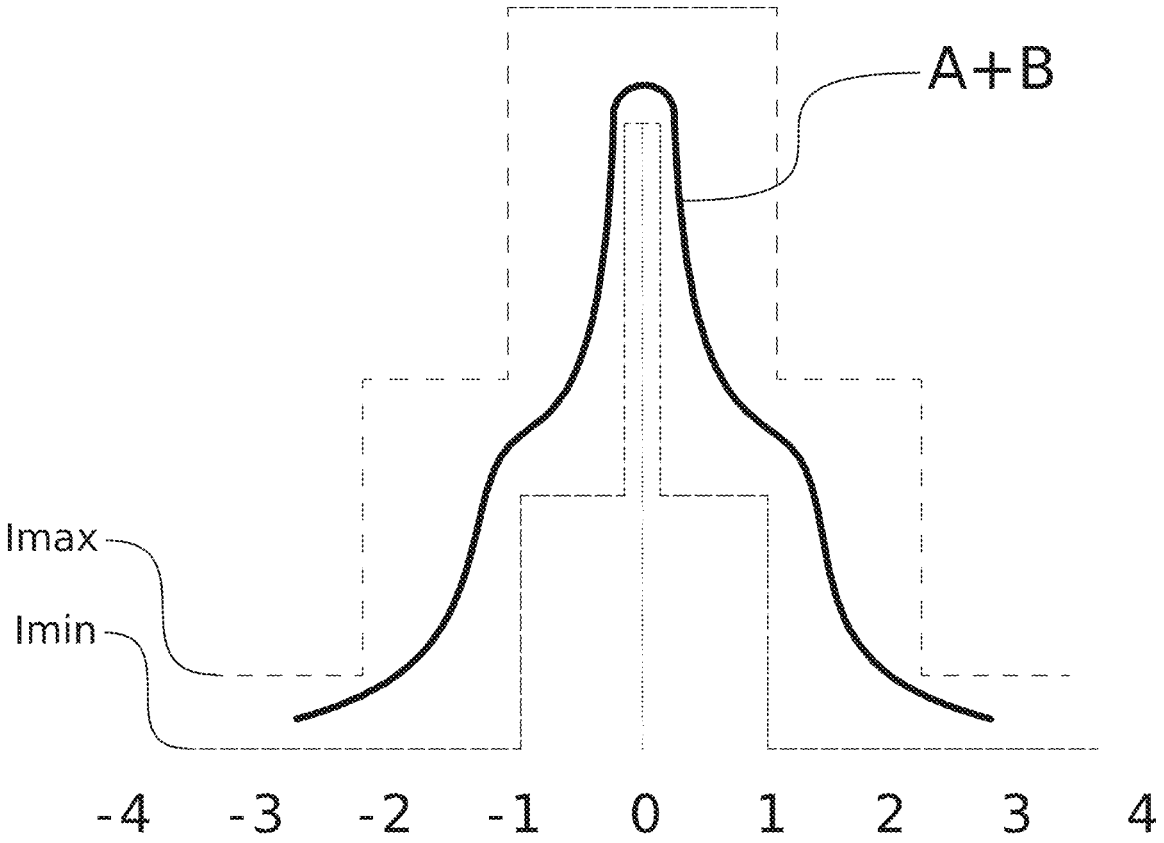
FIG. 3 illustrates the combined light pattern produced by the components of the illuminator of FIG. 1.

FIG. 3 shows the total output light pattern A+B, which is the sum of the output light patterns A, B of the first and second combination of components, 11, 20; 12, 20. In FIG. 3, the zero line represents the horizontal, i.e. the radial direction to all horizontal directions from and around the coverage angle of the illuminator. Here it should be noted that the illuminator may be constructed of several panels or sub-assemblies, for example, which have narrow coverage angles and when assembled, form a wider coverage angle up to 360 degrees. Ascending deviations from the zero line in the vertical plane in degrees are expressed with positive integers and descending with negative integers. As may be seen from FIG. 3, the total output light pattern A+B peaks at the zero line, i.e. the radial horizontal direction extending from the vertical center line of the flight obstacle illuminator. When observing the total output light pattern A+B to either direction perpendicular to the zero line in the vertical plane, one may observe a considerable decrease in light intensity. At approximately 3 degrees from the center line, the light intensity asymptotically approaches zero. Also noticeable from FIG. 3 is a slight shoulder at approximately 1 and 1 degrees from the center line, which is the net result of crossing between the summed wider first output light pattern A and the narrower second output light pattern B. The produced shoulder is particularly advantageous because the total output light pattern A+B thus manages to comply not only with the required minimum intensity requirements sketched with the dashed line $I_{min}$ but also the recommended maximum intensity requirements sketched with the dashed line $I_{max}$. Thus the total output light pattern can be modified from the conventional output light pattern of known illuminators.

The embodiment of FIG. 1 could be varied by introducing a second similar lens to the illuminator so that the first light emitting component would emit light to the first lens and the second light emitting component would emit light to the second lens. The summed output light patterns could still produce a pattern illustrated in FIG. 3.

Figure 4:
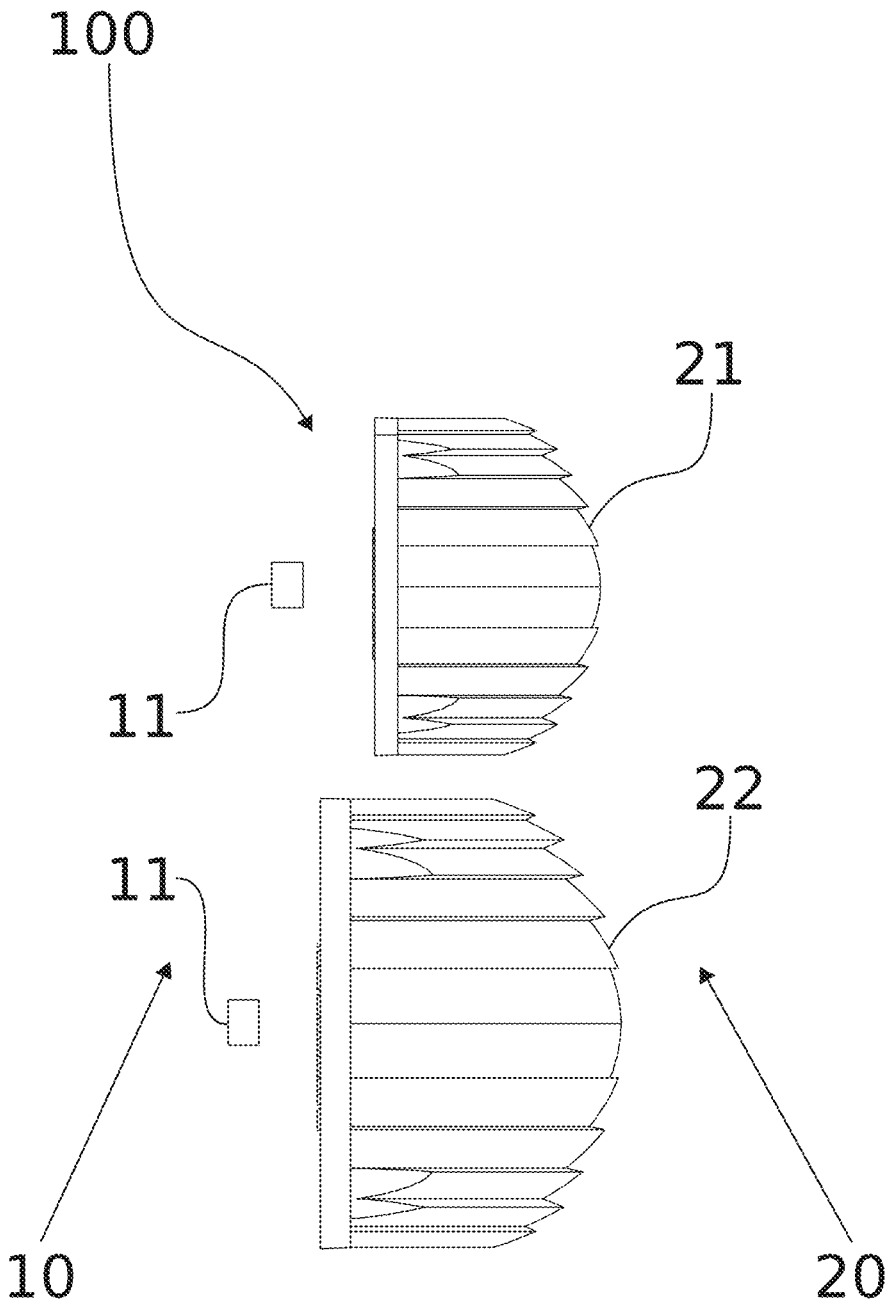
FIG. 4 illustrates a block side elevation view of an illuminator with two identical light emitting components.

An alternative flight obstacle illuminator 100 is depicted in FIG. 4, where two similar light emitting components 11 and two cooperating but mutually different lenses 21, 22 form two different combinations for producing a total output light pattern A, B, such as shown in FIG. 3. The light emitting components 11 of the light source 10 have similar optical sizes. However, the light path modifying properties of the first and second lens 21, 22 are different. The first lens 21 may have a smaller radius in the overall output surface than the second lens 22 thus leading to a wider output light pattern A than the second lens 22, which produces a narrower output light pattern B (FIG. 2). As a rule of thumb it may be calculated that for reducing the beam spread of the lens in half, the size of the lens would need to be quadrupled without modifying the optical size of the light source. For example in a double lens arrangement, where the first (wide) light output pattern has a width of three degrees and the same light source is used for the second (narrow) light output pattern having a width of 1.5 degrees, the second lens would need to be dimensioned to a size four times the size of the first lens. Alternatively or additionally, the first and second lenses may have different focal points. More specifically, the lenses 21, 22 may be Fresnel lenses. Also, it is possible to vary the distance of the light emitting component from the lens 21, 22 for modifying the output light pattern.

Figure 5:
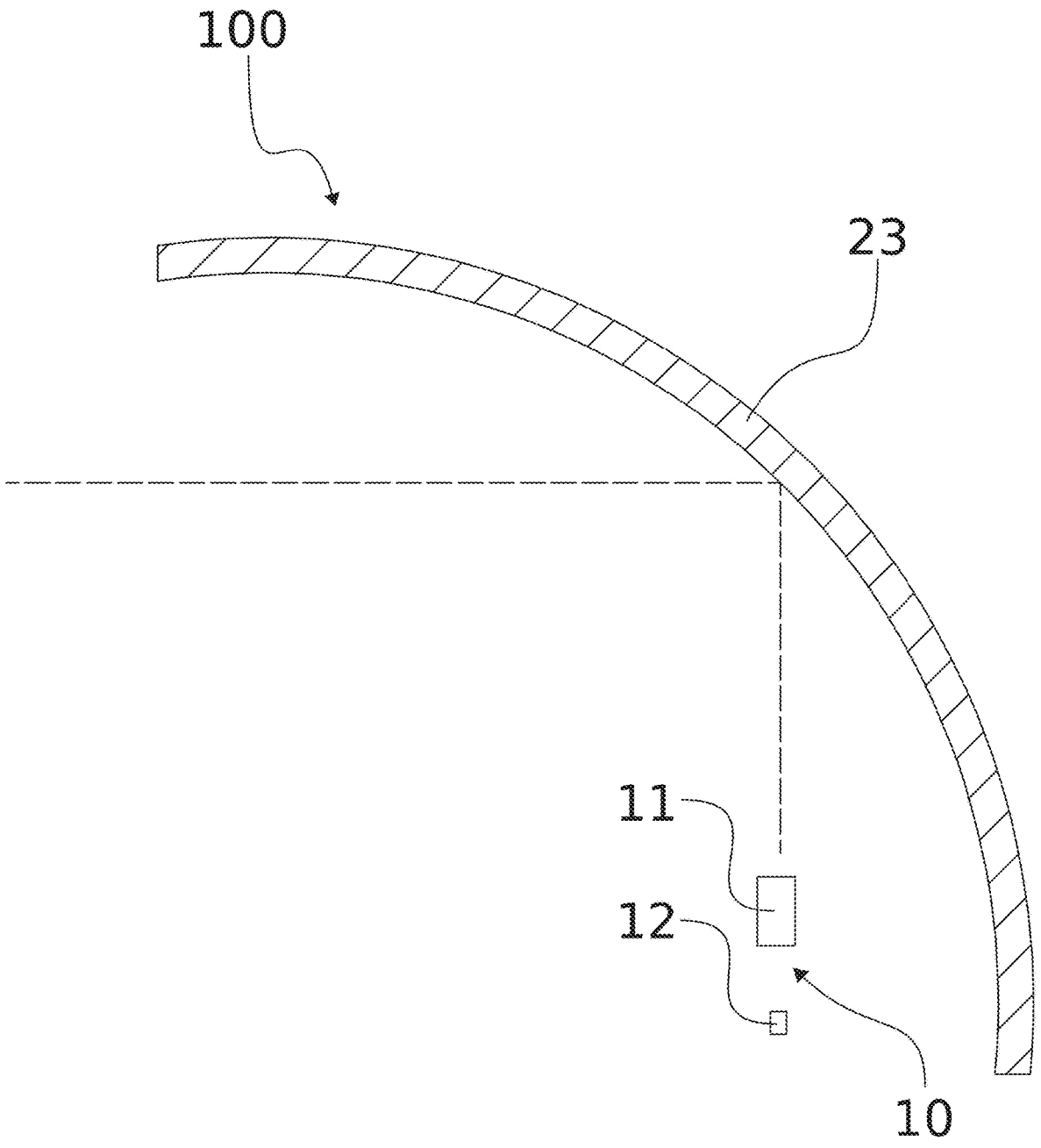
FIG. 5 illustrates a block side elevation view of an illuminator in accordance with another embodiment.

The embodiments above could be varied by replacing a lens or lenses of similar or different light path modifying properties with a reflector or reflectors. FIG. 5 shows a modification of the embodiment shown in FIG. 1, where the lens has been replaced with a concave reflector 23. The flight obstacle illuminator 100 according to the embodiment shown in FIG. 5 includes a light source 10 with a first light emitting component 11 and a second light emitting component 12. The optical size of the first light emitting component 11 is larger than that of the second light emitting component 12. The difference between optical sizes may be achieved with the above-described options of adding a dome to or increasing the size of the light emitting surface of the LED chip of the first light emitting component 11. The light emitting components 11, 12 emit light to the reflector 23, the concave reflective surface of which is configured to collect the emitted light beams and to guide the output light patterns as the first and second output light pattern A, B shown in FIG. 2, respectively.

A similar reflector replacement could be performed to the embodiment shown in FIG. 4, where the lenses of different size would be replaced with reflectors of different size.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

REFERENCE SIGNS LIST

| | |
|---|---|
| 10 | light source |
| 11 | first light emitting component, such as an LED |
| 12 | second light emitting component, such as an LED |
| 20 | optics |
| 21 | first lens |
| 22 | second lens |
| 23 | reflector |
| A | output light pattern of the first combination of components |
| B | output light pattern of the second combination of components |
| A + B | combined output light pattern of the first and second combination of components |
| $I_{min}$ | minimum requirement for light intensity as a function of deviation from the zero line |
| $I_{max}$ | recommended maximum for light intensity as a function of deviation from the zero line |

CITATION LIST

Patent Literature

EP 2541134 A2

Non Patent Literature

International Civil Aviation Organization: Annex 14 to Volume 1 (Aerodrome Design and Operations) of the Convention on International Civil Aviation, 6$^{th}$ Edition, July 2013, ISBN 978-92-9249-281-6

The invention claimed is:

1. An illuminator for warning of a flight obstacle or for aiding navigation comprising:

a light source comprising a first light emitting component and a second light emitting component, and optics comprising at least one light path modifying component positioned on the light path of the first or second light emitting component, wherein the first light emitting component of the light source and a light path modifying component of the optics form a first combination of components, the components of which are configured to cooperate so as to output a first output light pattern (A) having a width in a plane, wherein:

the first light emitting component has a first optical size and the second light emitting component has a second optical size, which is smaller than the first optical size, the second light emitting component and a light path modifying component of the optics form a second combination of components, which second combination is different to the first combination, the components of the second combination are configured to cooperate such to output a second output light pattern (B) having a width in said plane, which width of the second output light pattern (B) is narrower than that of the first output light pattern (A), and in that the total output light pattern (A+B) of the illuminator is a sum of the output light patterns (A, B) produced by the combinations of components, wherein:

either:

the optics comprise a lens as the at least one light path modifying component, and wherein the first and second light emitting component are configured to emit light to the lens, which lens forms the first combination of components with the first light emitting component so as to output the first output light pattern (A) and which lens forms the second combination of components with the second light emitting component so as to output the second output light pattern (B), or:

the optics comprise a first lens as one light path modifying component, which first lens forms the first combination of components with the first light emitting component so as to output the first output light pattern (A), and wherein the optics comprise a second lens as another light path modifying component, which second lens is optically similar to the first lens, which second lens forms the second combination of components with the second light emitting component so as to output the second output light pattern (B).

2. The illuminator according to claim 1, wherein each light emitting component of the light source is configured to emit light to the at least one light path modifying component of the optics.

3. The illuminator according to claim 1, wherein:

the first light emitting component has an emitting surface having a first area, the second light emitting component has an emitting surface having a second area, which is smaller than the first area, whereby the light emitting surfaces of different sizes are configured to output light patterns (A, B) of different width.

4. The illuminator according to claim 3, wherein the area of the emitting surface of the second light emitting component is 20 percent smaller than that of the first light emitting component.

5. The illuminator according to claim 1, wherein the width of the second output light pattern (B) is at most ⅔ of that of the first output light pattern (A).

6. The illuminator according to claim 1, wherein said plane is a vertical plane, whereby the illuminator is configured to produce a total output light pattern (A+B) formed by at least two light beams of different beam spread in the vertical dimension.

7. The illuminator according to claim 6, wherein the vertical plane extends radially from the vertical center line of the illuminator when in an installed configuration.

8. The illuminator according to claim 1, wherein the two combinations of components are both configured to emit light into the same direction.

9. The illuminator according to claim 1, wherein there is a space between the components in the combinations of components.

10. The illuminator according to claim 1, wherein the light emitting components are light emitting diodes (LED).

11. The illuminator according to claim 10, wherein either LED or either plurality of LEDs included in the first or second combination of components is/are domeless and the other LED or plurality of LEDs included in the other combination of components comprise a dome on top of the light emitting surface of the LED chip, and wherein said domeless LED chip or chips and LED chip or chips comprising a dome are configured to be integrated into a single surface mounted device.

12. The illuminator according to claim 1, wherein the second output light pattern (B) exhibits higher peak intensity than the first output light pattern (A).

13. The illuminator according to claim 1, wherein the components making up the illuminator form a flight obstacle illuminator or a navigational aid device.

14. The illuminator according to claim 1, wherein the width of the second output light pattern (B) is at most half of that of the first output light pattern (A).

15. The illuminator according to claim 1, wherein the width of the second output light pattern (B) is at most ⅓ of that of the first output light pattern (A).

16. The illuminator according to claim 1, wherein the width of the second output light pattern (B) is less than ⅓ of that of the first output light pattern (A).

17. The illuminator according to claim 1, where the first light emitting component and second light emitting component are configured to emit light in the same direction.

* * * * *